US011084155B2

(12) United States Patent
Matsuda

(10) Patent No.: US 11,084,155 B2
(45) Date of Patent: Aug. 10, 2021

(54) HYDRAULIC STRIKING DEVICE

(71) Applicant: Furukawa Rock Drill Co., Ltd., Tokyo (JP)

(72) Inventor: Toshio Matsuda, Takasaki (JP)

(73) Assignee: Furukawa Rock Drill Co., Ltd., Tokyo (JP)

( * ) Notice: Subject to any disclaimer, the term of this patent is extended or adjusted under 35 U.S.C. 154(b) by 232 days.

(21) Appl. No.: 16/329,160

(22) PCT Filed: Aug. 21, 2017

(86) PCT No.: PCT/JP2017/029752
§ 371 (c)(1),
(2) Date: Feb. 27, 2019

(87) PCT Pub. No.: WO2018/043175
PCT Pub. Date: Mar. 8, 2018

(65) Prior Publication Data

US 2019/0224835 A1 Jul. 25, 2019

(30) Foreign Application Priority Data

Aug. 31, 2016 (JP) ..... JP2016-168995

(51) Int. Cl.
*B25D 9/26* (2006.01)
*B25D 9/14* (2006.01)
(Continued)

(52) U.S. Cl.
CPC ..... *B25D 9/26* (2013.01); *B25D 9/145* (2013.01); *B25D 9/18* (2013.01); *B25D 9/20* (2013.01);
(Continued)

(58) Field of Classification Search
CPC .... B25D 9/26; B25D 9/145; B25D 2209/002; B25D 2250/125
See application file for complete search history.

(56) References Cited

U.S. PATENT DOCUMENTS 3,552,269 A * 1/1971 Arndt ..... B25D 9/26 91/277
3,759,335 A * 9/1973 Coyne ..... E21B 4/145 173/91
(Continued)

FOREIGN PATENT DOCUMENTS

EP 0 739 691 A1 10/1996
EP 0739691 B1 * 3/2000 ..... B25D 9/26
(Continued)

OTHER PUBLICATIONS

English Translation of International Preliminary Report on Patentability in corresponding Japanese Patent Application No. PCT/JP2017/029752, dated Mar. 14, 2019, 6 pgs.
(Continued)

*Primary Examiner* — Nathaniel C Chukwurah
*Assistant Examiner* — Lucas E. A. Palmer
(74) *Attorney, Agent, or Firm* — Young Basile Hanlon & MacFarlane, P.C.

(57) ABSTRACT

Provided is a hydraulic striking device in which a reverse operation circuit and a forward operation circuit can switch connection states to a high pressure circuit and a low pressure circuit by means of an operation switching valve. Further, the hydraulic striking device is configured to be selectable between a reverse operation mode or a forward operation mode by operating the operation switching valve. A high/low pressure switching portion is provided with a shortening portion for reducing the time required for high/low pressure switching operation in piston front and rear chambers in association with retraction of a valve to be
(Continued)

shorter than the time required for high/low pressure switching operation in the piston front and rear chambers in association with advancement of the valve.

12 Claims, 7 Drawing Sheets

(51) Int. Cl.
*B25D 9/20* (2006.01)
*B25D 9/18* (2006.01)

(52) U.S. Cl.
CPC .. *B25D 2209/002* (2013.01); *B25D 2209/007* (2013.01); *B25D 2222/72* (2013.01); *B25D 2250/125* (2013.01)

(56) References Cited

U.S. PATENT DOCUMENTS 4,006,783 A * 2/1977 Granholm ..... B25D 9/145 173/177
4,314,612 A * 2/1982 Thomas ..... B25D 9/26 173/204
4,646,854 A * 3/1987 Arndt ..... B25D 9/145 173/207
4,819,542 A * 4/1989 Fadeev ..... E21B 1/30 91/172
4,858,702 A * 8/1989 Piras ..... B25D 9/145 173/208
5,038,668 A * 8/1991 Arndt ..... B25D 9/26 91/290
5,056,606 A * 10/1991 Barthomeuf ..... B25D 17/245 173/13
5,117,921 A * 6/1992 Bartels ..... B25D 9/145 173/105
5,372,196 A * 12/1994 Andersson ..... B25D 9/20 175/296
5,979,291 A * 11/1999 Juvonen ..... B25D 9/145 91/239
2003/0136569 A1* 7/2003 Gotou ..... F27D 3/1527 173/11
2009/0090525 A1* 4/2009 Juvonen ..... E02F 3/966 173/1
2009/0223689 A1* 9/2009 Birath ..... E21B 1/02 173/13
2009/0321099 A1* 12/2009 Birath ..... B25D 9/16 173/1
2009/0321100 A1* 12/2009 Andersson ..... B25D 9/18 173/1
2014/0144660 A1* 5/2014 Sangster ..... B25D 9/18 173/112
2014/0326473 A1* 11/2014 Comarmond ..... B25D 9/26 173/1
2015/0336256 A1* 11/2015 Moore ..... B25D 9/12 173/1
2015/0375383 A1* 12/2015 Autschbach ..... B25D 9/12 173/20
2016/0199969 A1* 7/2016 Moore ..... B25D 9/145 173/115
2017/0001293 A1* 1/2017 Matsuda ..... B25D 9/20
2017/0001294 A1* 1/2017 Koizmui ..... B25D 9/20
2017/0312901 A1* 11/2017 Comarmond ..... B25D 9/18
2018/0345470 A1* 12/2018 Piras ..... B25D 17/245
2019/0224835 A1* 7/2019 Matsuda ..... B25D 9/18

FOREIGN PATENT DOCUMENTS

GB 171944 A 12/1921
JP S51-111401 A 10/1976
JP H02-298477 A 12/1990
JP 2005-177899 A 7/2005
JP 4912785 B2 4/2012
WO 02/090057 A1 11/2002
WO WO-2005058550 A1 * 6/2005 ..... B25D 9/26
WO 2015/115105 A1 8/2015
WO WO-2015115105 A1 * 8/2015 ..... B25D 9/18

OTHER PUBLICATIONS

Extended European Search Report in corresponding European Application No. 17846183.3, dated Aug. 2, 2019, 7 pgs.

* cited by examiner

IMPACT POINT
200
111
112
113
114
129
128
110
120
121
123
125
126'
130
309
308
313
300
102
101
103
104
105
134
135
136
137
210
310

HYDRAULIC STRIKING DEVICE

CROSS REFERENCE TO RELATED APPLICATION(S)

This application claims priority to Japanese Patent Application No. 2016-168995, filed Aug. 31, 2016, which is herein incorporated by reference in its entirety.

TECHNICAL FIELD

The present invention relates to a hydraulic striking device, such as a rock drill and a breaker.

BACKGROUND

As a hydraulic striking device of this type, for example, a technology described in JP 4912785 B has been disclosed. A hydraulic striking device described in JP 4912785 B will be described with reference to FIG. 9 as appropriate. With regard to each of a piston (arranged on the upper side in FIG. 9) and a valve (arranged on the lower side in FIG. 9) in FIG. 9, the upper side of the axis illustrates a state of the piston or the valve when the piston is in a phase of turning from advancement to retraction and the lower side of the axis illustrates a state of the piston or the valve when the piston is in a phase of turning from retraction to advancement.

The hydraulic striking device includes a cylinder 500 and a piston 522, as illustrated in FIG. 9. The piston 522 is a solid cylinder body and has piston large-diameter portions 523 and 524 substantially in the middle thereof. In front of the piston large-diameter portion 523, a piston medium-diameter portion 525 is disposed, and, in the rear of the piston large-diameter portion 524, a piston small-diameter portion 526 is disposed.

Substantially in the middle between the piston large-diameter portions 523 and 524, an annular valve switching groove 527 is formed. Outer diameter of the piston medium-diameter portion 525 is set larger than outer diameter of the piston small-diameter portion 526. This configuration causes the piston 522 to have a larger pressure receiving area in a piston rear chamber 502, to be described later, that is, a diameter difference between the piston large-diameter portion 524 and the piston small-diameter portion 526, than a pressure receiving area in a piston front chamber 501, to be described later, that is, a diameter difference between the piston large-diameter portion 523 and the piston medium-diameter portion 525.

The piston 522 being slidably fitted in the inside of a cylinder 500 causes the piston front chamber 501 and the piston rear chamber 502 to be respectively defined inside the cylinder 500. The piston front chamber 501 is constantly connected to a high pressure circuit 513 via a piston front chamber passage 516. On the other hand, the piston rear chamber 502 is configured to be communicable with either the high pressure circuit 513 or a low pressure circuit 519 alternately through switching between advancement and retraction of the switching valve mechanism 540. To the high pressure circuit 513 and the low pressure circuit 519, a high pressure accumulator 536 and a low pressure accumulator 537 are disposed, respectively.

The switching valve mechanism 540 includes, inside the cylinder 500, a valve chamber 506 formed in a non-concentric manner with the piston 522 and a valve 528 slidably fitted in the valve chamber 506. The valve chamber 506 has a valve front chamber 508, a valve main chamber 507, and a valve rear chamber 509 in sequence from the front to the rear. In the valve main chamber 507, a piston rear chamber high pressure port 510, a piston rear chamber switching port 511, and a piston rear chamber low pressure port 512 are disposed separated from each other at predetermined intervals in sequence from the front to the rear.

The valve 528 is a solid cylinder body and has valve large-diameter portions 529 and 530 substantially in the middle thereof. In front of the valve large-diameter portion 529, a valve medium-diameter portion 531 is disposed, and, in the rear of the valve large-diameter portion 530, a valve small-diameter portion 532 is disposed. Between the valve large-diameter portion 530 and the valve small-diameter portion 532, a valve retraction restricting portion 533 that restricts the valve 528 from moving rearward is disposed. An annular piston rear chamber high pressure switching groove 534 and a piston rear chamber low pressure switching groove 535 are disposed between the valve large-diameter portions 529 and 530 and between the valve large-diameter portion 530 and the valve retraction restricting portion 533, respectively.

The valve large-diameter portions 529 and 530, the valve medium-diameter portion 531, and the valve small-diameter portion 532 are configured to be slidably fitted in the valve main chamber 507, the valve front chamber 508, and the valve rear chamber 509, respectively. Outer diameter of the valve medium-diameter portion 531 is set larger than outer diameter of the valve small-diameter portion 532. Therefore, pressure receiving area of the valve medium-diameter portion 531 side is configured to be larger than pressure receiving area of the valve small-diameter portion 532 side.

Between the piston front chamber 501 and the piston rear chamber 502, a piston advancement control port (short stroke) 503*a*, a piston advancement control port 503, a piston retraction control port 504, and an oil discharge port 505 are disposed separated from each other at predetermined intervals from the front to the rear.

The high pressure circuit 513 is connected to the piston rear chamber high pressure port 510 via a high pressure passage 514. The high pressure circuit 513 is connected to the piston front chamber 501 via the piston front chamber passage 516, which branches off from the high pressure passage 514, and therewith connected to the valve rear chamber 509 via a valve rear chamber passage 517, which branches off from the high pressure passage 514.

To the valve front chamber 508, one end of a valve control passage 518 is connected, and the other end of the valve control passage 518 splits into a valve front chamber high pressure passage (short stroke) 518*a*, a valve front chamber high pressure passage 518*b*, and a valve front chamber low pressure passage 518*c*. The valve front chamber high pressure passage (short stroke) 518*a* is connected to the piston advancement control port (short stroke) 503*a*.

The valve front chamber high pressure passage 518*b* and the valve front chamber low pressure passage 518*c* are connected to the piston advancement control port 503 and the piston retraction control port 504, respectively. The piston rear chamber 502 is connected to the piston rear chamber switching port 511 via a piston rear chamber passage 515. The oil discharge port 505 is connected to the low pressure circuit 519 via a valve low pressure passage 520. The piston rear chamber low pressure port 512 is connected to the low pressure circuit 519 via a piston low pressure passage 521.

The piston advancement control port (short stroke) 503*a*, the piston advancement control port 503, the valve front chamber high pressure passage (short stroke) 518*a*, and the valve front chamber high pressure passage 518*b* constitute a known stroke switching mechanism, and operation of a variable throttle disposed in the valve front chamber high pressure passage (short stroke) 518*a* enables a piston stroke to be adjusted steplessly from a short stroke (the variable throttle is in a full-open state) to a normal stroke (the variable throttle is in a full-close state).

In this hydraulic striking device, the piston 522 constantly is biased rearward because the piston front chamber 501 is constantly connected to high pressure. When the piston rear chamber 502 is connected to high pressure through operation of the valve 528, the piston 522 advances due to a pressure receiving area difference, and, when the piston rear chamber 502 is connected to low pressure through operation of the valve 528, the piston 522 retracts.

The valve 528 is constantly biased forward because the valve rear chamber 509 is constantly connected to high pressure. When the valve control passage 518 comes into communication with the valve front chamber 508 and the valve front chamber 508 is thereby connected to high pressure, the valve 528 retracts due to a pressure receiving area difference, and, when the valve control passage 518 comes into communication with the oil discharge port 505 and the valve front chamber 508 is thereby connected to low pressure, the valve 528 advances.

BRIEF SUMMARY

A hydraulic striking device of this type is sometimes required to adjust striking power. Measures for adjusting striking power are considered to include a measure of disposing a pressure adjustment valve and reducing pressure of pressurized oil supplied to the hydraulic striking device and a measure of, by operating the stroke switching mechanism and shortening a stroke, reducing piston velocity at the time of strikes. However, the measure of disposing the pressure adjustment valve has a problem in that controllability is low, and the measure of using the stroke switching mechanism has a problem in that operability is low.

Accordingly, the present invention has been made focusing on such problems, and a problem to be solved by the present invention is to provide a hydraulic striking device the striking characteristics of which can be easily changed.

In order to achieve the object mentioned above, according to a first mode of the present invention, there is provided a hydraulic striking device including: a cylinder; a piston slidably fitted in an inside of the cylinder; a piston front chamber and a piston rear chamber defined between an outer peripheral surface of the piston and an inner peripheral surface of the cylinder and arranged separated from each other in axially front and rear directions; and a switching valve mechanism configured to switch the piston front chamber and the piston rear chamber into a high pressure state and a low pressure state in an interchanging manner, the piston being advanced and retracted in the cylinder to strike a rod for striking, wherein the switching valve mechanism includes a valve chamber formed in the cylinder in a non-concentric manner with the piston, a valve slidably fitted in the valve chamber and to which a high/low pressure switching portion for switching the piston front chamber and the piston rear chamber into a high pressure state and a low pressure state in an interchanging manner is formed, a valve biasing portion configured to constantly bias the valve forward, and a valve control portion configured to, when pressurized oil is supplied, move the valve rearward against biasing force by the valve biasing portion, to the switching valve mechanism, a reverse operation circuit and a forward operation circuit are connected and connection states of the reverse operation circuit and the forward operation circuit to a high pressure circuit and a low pressure circuit are interchangeable by means of an operation switching valve, the valve biasing portion includes a reverse operation biasing portion configured to operate when the reverse operation circuit is connected to the high pressure circuit and a forward operation biasing portion configured to operate when the forward operation circuit is connected to the high pressure circuit, the hydraulic striking device is configured to, through operation of the operation switching valve, be selectable between a reverse operation mode in which the valve and the piston are operated in opposite phases and a forward operation mode in which the valve and the piston are operated in the same phase, and to the high/low pressure switching portion, a shortening portion for reducing time required for high/low pressure switching operation in the piston front chamber and the piston rear chamber in association with retraction of the valve to be shorter than time required for high/low pressure switching operation in the piston front chamber and the piston rear chamber in association with advancement of the valve is disposed.

According to the hydraulic striking device according to the one aspect of the present invention, since time required for high/low pressure switching operation at the time of advancement and retraction of the piston in association with retraction of the valve in the forward operation mode is shortened, time required for high/low pressure switching operation at the time of advancement and retraction of the piston in association with advancement of the valve in the reverse operation mode is relatively extended.

That is, focusing on the piston rear chamber, time required for switching from a low pressure state to a high pressure state in the forward operation mode becomes shorter than that in the reverse operation mode, which causes a piston retraction stroke in the forward operation mode to be shortened and the piston retraction stroke in the reverse operation mode to be relatively extended. Therefore, selection of the forward operation mode by means of the operation switching valve causes a stroke to be set at a short stroke and selection of the reverse operation mode causes a stroke to be set at a long stroke.

The conventional stroke adjustment mechanism described above is a mechanism in which a stroke is adjusted by adjusting a degree of opening of the variable throttle disposed to the cylinder main body and is not suitable for a use in which a long stroke and a short stroke are switched in accordance with work details.

Although providing a remotely operable stroke switching valve separately has been proposed, a new actuator is required to be disposed in the cylinder in this case. Thus, a hose conduit is required to be additionally disposed on a guide shell, which causes another problem.

By contrast, since the hydraulic striking device according to the one aspect of the present invention enables the operation switching valve to be disposed on the carriage main body side, no modification is necessary to the guide shell and related portions thereof.

In the hydraulic striking device according to the one aspect of the present invention, it is preferable that the shortening portion be a difference between an opening width of a port that is closed by the valve at the time of advancement of the valve and an opening width of a port that is closed by the valve at the time of retraction of the valve.

Such a configuration makes it unnecessary to dispose an actuator separately because the shortening portion is the difference between the opening width of the port that is closed by the valve at the time of advancement of the valve and the opening width of the port that is closed by the valve at the time of retraction of the valve, and is suitable for achieving a stroke switching mechanism by use of a simple configuration.

In the hydraulic striking device according to the one aspect of the present invention, it is preferable that the valve control portion include a delaying portion including a throttle configured to provide no restriction when pressurized oil is supplied and adjust a flow rate when pressurized oil is discharged.

Such a configuration enables a piston stroke to be extended in the reverse operation mode because a delaying portion including the throttle configured to provide no restriction when pressurized oil is supplied and adjust a flow rate when pressurized oil is discharged is disposed to the valve control portion. Thus, such a configuration is suitable for increasing a degree of change between a short stroke in the forward operation mode and a long stroke in the reverse operation mode.

It is preferable that the hydraulic striking device according to the one aspect of the present invention include a high pressure accumulator disposed to the reverse operation circuit and a low pressure accumulator disposed to the forward operation circuit.

Such a configuration is suitable because a high pressure accumulator and a low pressure accumulator are disposed to the reverse operation circuit and the forward operation circuit, respectively, and the high pressure accumulator and the low pressure accumulator are thereby arranged on the high pressure circuit side and the low pressure circuit side, respectively, in a connection state of the reverse operation mode, which is used by a regular work, that is, a state in which the reverse operation circuit and the forward operation circuit are connected to the high pressure circuit and the low pressure circuit, respectively.

It is preferable that the hydraulic striking device according to the one aspect of the present invention include pairs of a high pressure accumulator and a low pressure accumulator respectively disposed to the reverse operation circuit and the forward operation circuit and that each of the pairs of the high pressure accumulator and the low pressure accumulator be disposed side by side in such a way that the high pressure accumulator is disposed on the switching valve mechanism side.

Such a configuration is suitable because pairs of a high pressure accumulator and a low pressure accumulator are disposed to each of the reverse operation circuit and the forward operation circuit side by side in such a way that the high pressure accumulators are disposed on the switching valve mechanism side and the accumulators thereby work normally in both connection states, the reverse operation mode and the forward operation mode.

As described above, according to the present invention, it is possible to provide a hydraulic striking device the striking characteristics of which can be easily changed.

DETAILED DESCRIPTION

Figure 1:
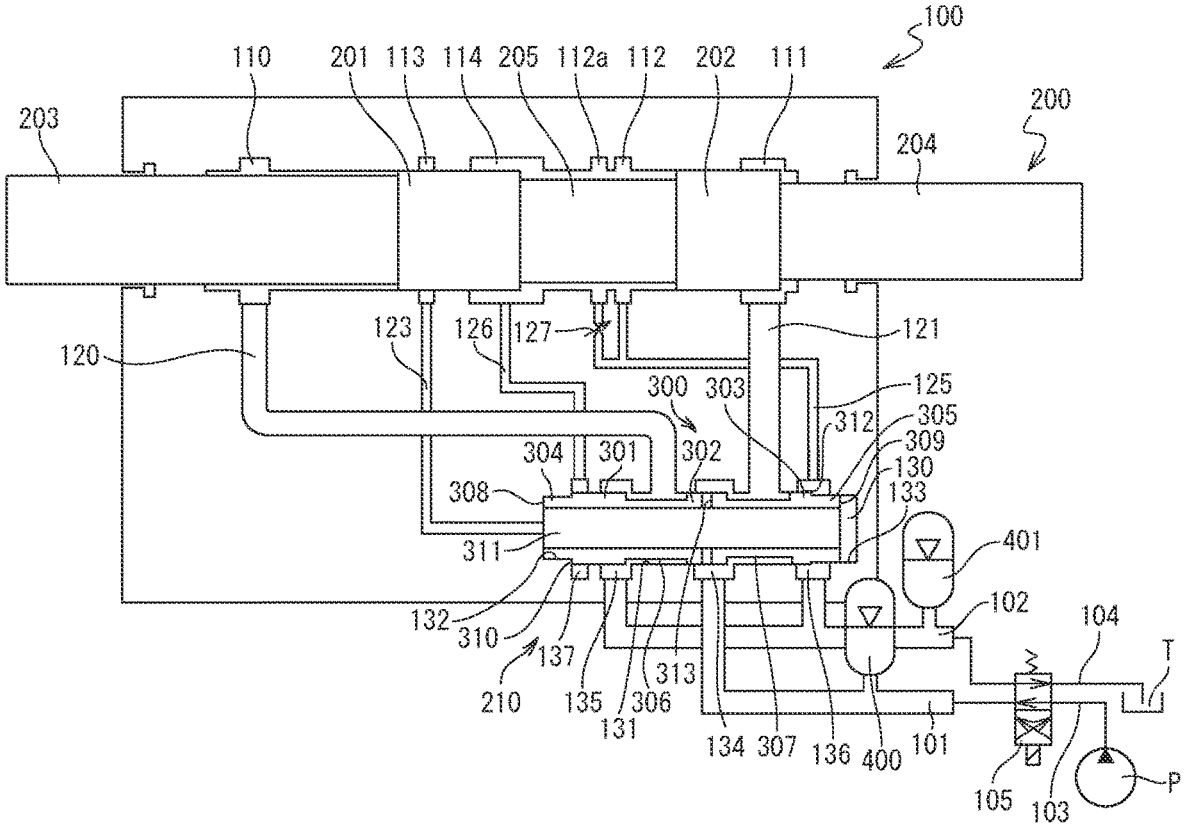
FIG. 1 is a schematic view of a first embodiment of a hydraulic striking device according to the present invention.

Hereinafter, respective embodiments of the present invention will be described with reference to the drawings as appropriate. However, the drawings are schematic. Therefore, it should be noted that a relation and ratio between thickness and planar dimensions, and the like are different from actual ones, and portions where dimensional relations and ratios are different from one another among the drawings are also included.

In addition, the embodiments, which will be described below, exemplify a device and method to embody a technical idea of the present invention, and the technical idea of the present invention does not limit materials, shapes, structures, arrangements, and the like of the constituent components to those described in the embodiments below. In all the drawings, the same reference numerals are assigned to the same constituent components. A component that has the same function as another component but the layout or shape of which is altered is indicated by adding an apostrophe to the same reference numeral.

As used herein, a "forward operation mode" refers to a mode in which advancing and retracting movements of a piston and advancing and retracting movements of a valve operate in the same phase and a "reverse operation mode" refers to a mode in which advancing and retracting movements of a piston and advancing and retracting movements of a valve operate in opposite phases. In general hydraulic striking devices, the reverse operation mode is often employed in the expectation that operating advancing and retracting movements of a piston and advancing and retracting movements of a valve in opposite phases causes reaction forces to offset each other, and a description will be made herein assuming the reverse operation mode to be a regular operation mode.

First, a configuration of a hydraulic striking device of a first embodiment of the present invention will be described with reference to FIGS. 1 and 2.

As illustrated in FIG. 1, the hydraulic striking device of the first embodiment includes a cylinder 100 and a piston 200 that is slidably fitted in the inside of the cylinder 100 in such a way as to be slidably movable along the axial direction. The piston 200 has a large-diameter portion (front) 201 and a large-diameter portion (rear) 202 in an axially middle portion and small-diameter portions 203 and 204 that are formed in front and rear of the large-diameter portions 201 and 202. Substantially in the middle between the piston large-diameter portions 201 and 202, an annular valve switching groove 205 is formed.

The piston 200 being disposed slidably fitted in the cylinder 100 causes a piston front chamber 110 and a piston rear chamber 111 to be defined separated from each other in the axially front and rear directions, respectively, between the outer peripheral surface of the piston 200 and the inner peripheral surface of the cylinder 100. Inside the cylinder 100, a switching valve mechanism 210 is disposed that switches communication of the piston front chamber 110 and the piston rear chamber 111 with a high pressure circuit 103 and a low pressure circuit 104 in an interchanging manner and supplies and discharges hydraulic oil so that advancing and retracting movements of the piston 200 are repeated.

The switching valve mechanism 210 includes, inside the cylinder 100, a valve chamber 130 formed in a non-concentric manner with the piston 200 and a valve (spool) 300 slidably fitted in the valve chamber 130. The valve chamber 130 has a valve chamber small-diameter portion 132, a valve chamber large-diameter portion 131, and a valve chamber medium-diameter portion 133 formed in sequence from the front to the rear. To the valve chamber large-diameter portion 131, a valve control chamber 137, a piston front chamber forward operation port 135, a piston reverse operation port 134, and a piston rear chamber forward operation port 136 are disposed separated from each other at predetermined intervals from the front to the rear.

The base end side (carriage main body side) of the high pressure circuit 103 and the base end side of the low pressure circuit 104 are connected to a pump P and a tank T, respectively. The tip end side (cylinder 100 side) of each of the high pressure circuit 103 and the low pressure circuit 104 is connected to either a reverse operation circuit 101 or a forward operation circuit 102 via an operation switching valve 105 in a switchable manner. To the reverse operation circuit 101 and the forward operation circuit 102, a high pressure accumulator 400 and a low pressure accumulator 401 are disposed, respectively.

To the piston front chamber 110, a piston front chamber passage 120 is connected that communicates the piston front chamber 110 with either the reverse operation circuit 101 or the forward operation circuit 102 through switching between advancement and retraction of the valve 300. On the other hand, to the piston rear chamber 111, a piston rear chamber passage 121 is connected that communicates the piston rear chamber 111 with either the reverse operation circuit 101 or the forward operation circuit 102 through switching between advancement and retraction of the valve 300.

Between the piston front chamber 110 and the piston rear chamber 111, a piston retraction control port 113, a valve control port 114, and piston advancement control ports 112 are disposed separated from each other at predetermined intervals from the front to the rear. With regard to the piston advancement control ports 112, opening portions for a normal stroke and a short stroke are disposed at two positions. A piston advancement control port 112*a* on the piston front chamber 110 side is a port that is for the short stroke and is provided with a variable throttle 127. A description will be made herein under the assumption that the normal stroke is set, that is, with the variable throttle 127 set at a full close state, the piston advancement control port 112 on the piston rear chamber 111 side works.

Figure 2:
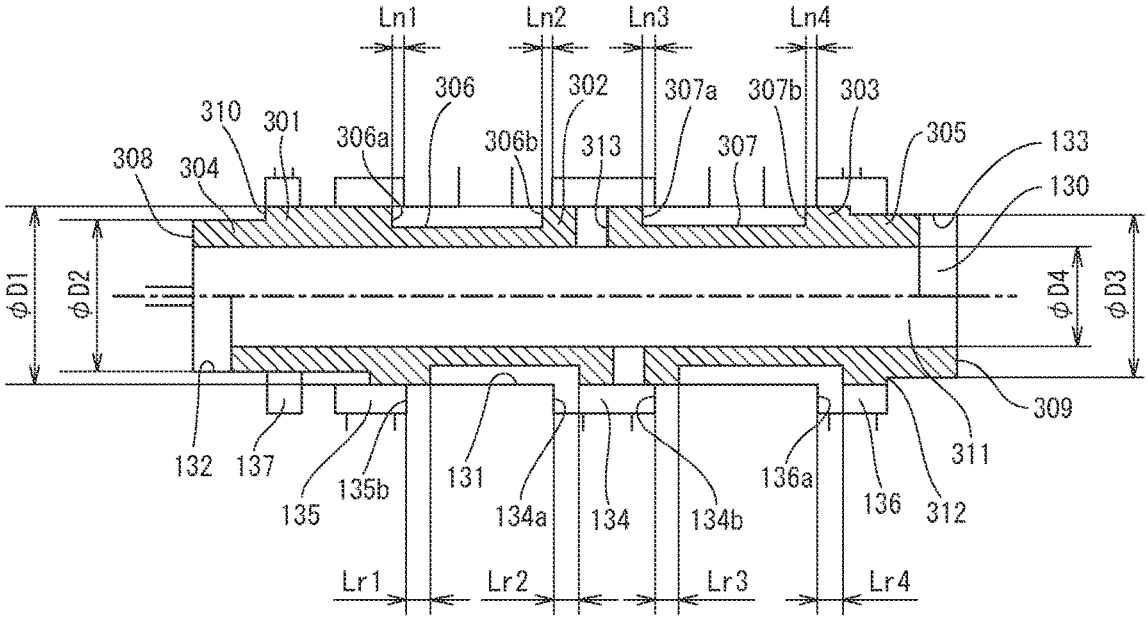
FIG. 2 is an explanatory diagram of relationships between a valve main body and ports in the hydraulic striking device according to the first embodiment.

As illustrated in FIG. 2, the valve 300 is a hollow cylindrically shaped valve body that has an axially penetrating valve hollow passage 311.

Figures 6A, 6B, 6C, 6D:
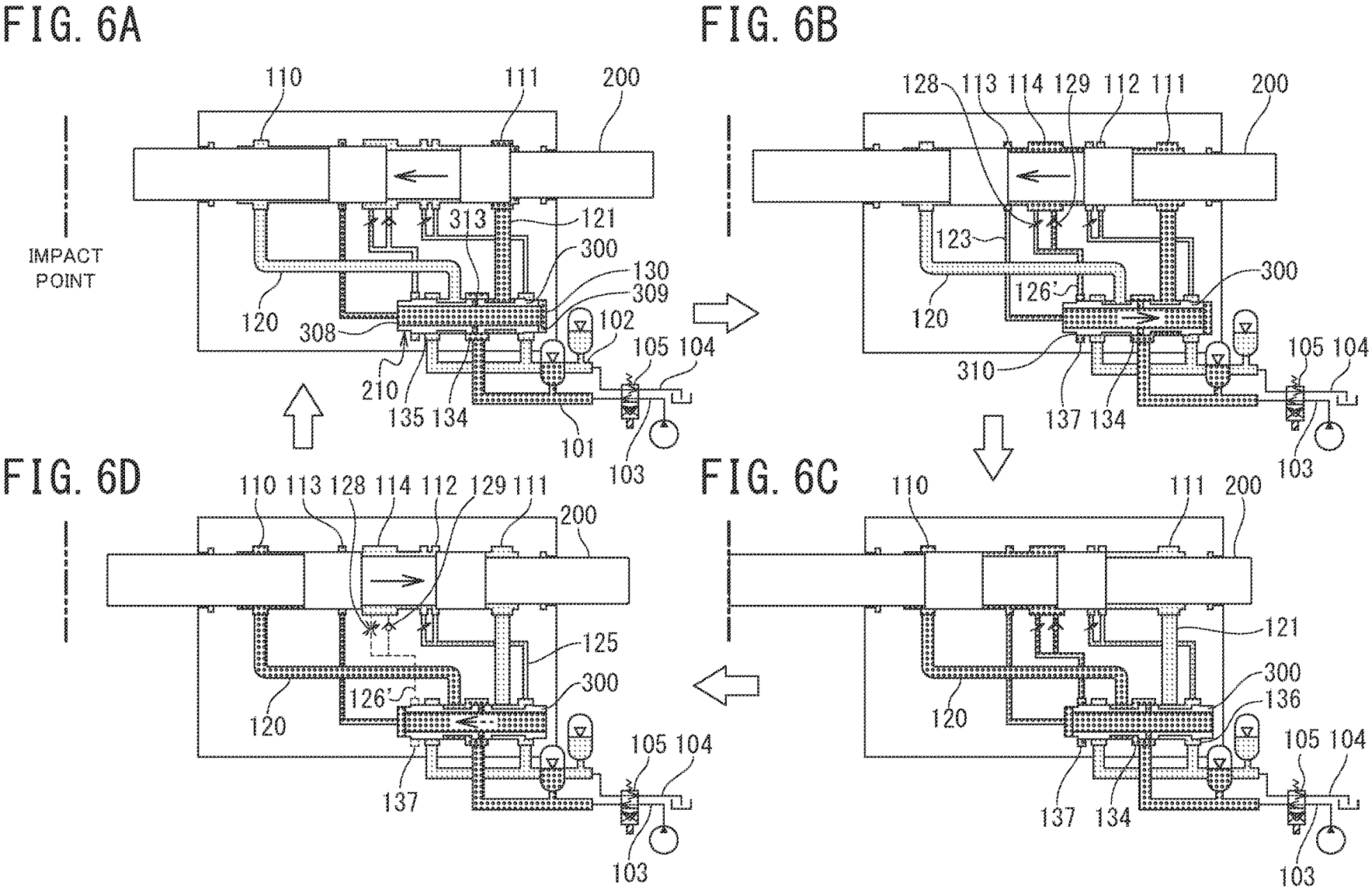
FIGS. 6A to 6D are operating principle diagrams of the hydraulic striking device according to the second embodiment and illustrates a reverse operation mode.
Figure 7B:
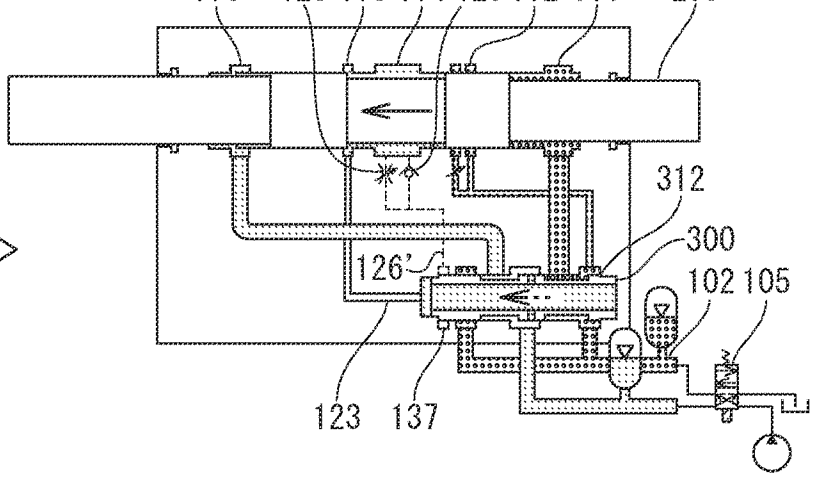
FIGS. 7A to 7D are operating principle diagrams of the hydraulic striking device according to the second embodiment and illustrates a forward operation mode.
Figure 7C:
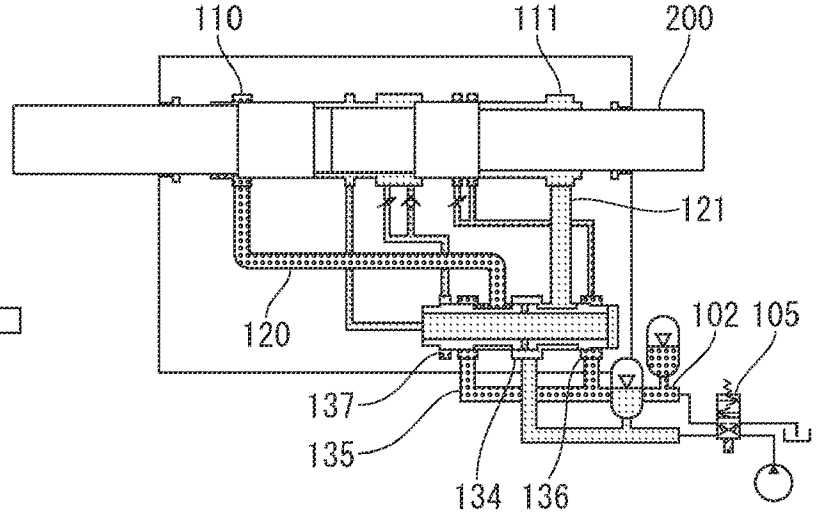
Figure 7A:
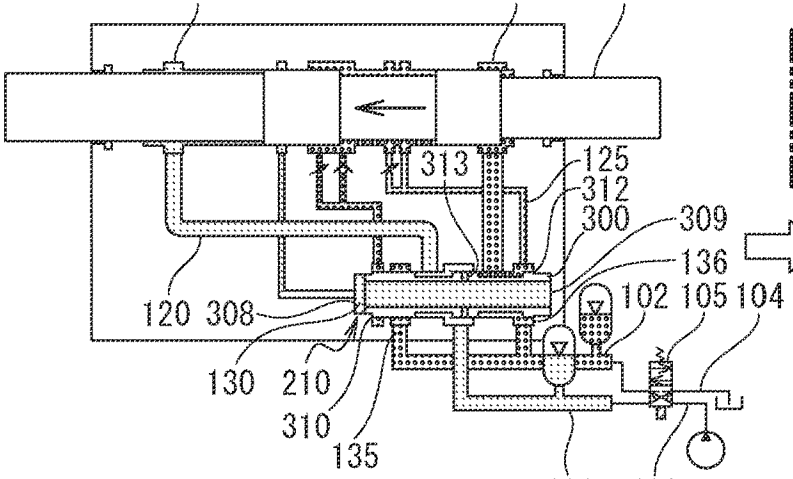
Figure 7D:
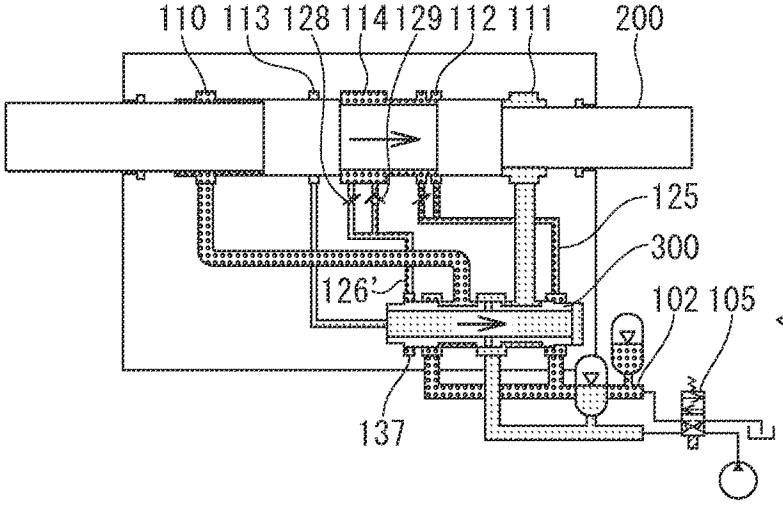

In FIG. 2, the upper side of the axis illustrates a state in which the piston retraction control port 113 comes into communication while the piston 200 is advancing when the reverse operation circuit 101 is connected to the high pressure circuit 103 and the valve 300 thereby starts to move rearward (FIG. 6B, to be described later) or a state in which the piston advancement control port 112 comes into communication while the piston 200 is retracting when the forward operation circuit 102 is connected to the high pressure circuit 103 and the valve 300 thereby starts to move rearward (FIG. 7D, to be described later).

In FIG. 2, the lower side of the axis illustrates a state in which the piston advancement control port 112 comes into communication while the piston 200 is retracting when the reverse operation circuit 101 is connected to the high pressure circuit 103 and the valve 300 thereby starts to move forward (FIG. 6D, to be described later) or a state in which the piston retraction control port 113 comes into communication while the piston 200 is advancing when the forward operation circuit 102 is connected to the high pressure circuit 103 and the valve 300 thereby starts to move forward (FIG. 7B, to be described later).

The valve 300 has, on the outer peripheral surface, valve large-diameter portions 301, 302, and 303, a valve small-diameter portion 304 that is disposed in front of the valve large-diameter portion 301, and a valve medium-diameter portion 305 that is disposed in the rear of the valve large-diameter portion 303. Between the valve large-diameter portions 301 and 302, an annular piston front chamber switching groove 306 is disposed. Between the valve large-diameter portions 302 and 303, an annular piston rear chamber switching groove 307 is disposed. In the embodiment, these piston front chamber switching groove 306 and piston rear chamber switching groove 307 correspond to the "high/low pressure switching portion" described in the Brief Summary above.

The switching valve mechanism 210 is configured in such a way that the valve large-diameter portions 301, 302, and 303, the valve small-diameter portion 304, and the valve medium-diameter portion 305 are slidably fitted in the valve chamber large-diameter portion 131, the valve chamber small-diameter portion 132, and the valve chamber medium-diameter portion 133, respectively.

The front end face and the rear end face of the valve 300 are a valve front end face 308 and a valve rear end face 309, respectively. At boundaries between the valve small-diameter portion 304 and the valve large-diameter portion 301 and between the valve large-diameter portion 303 and the valve medium-diameter portion 305, a valve stepped face (front) 310 and a valve stepped face (rear) 312 are formed, respectively. In a middle portion of the valve large-diameter portion 302, valve main body reverse operation passages 313 that penetrate the valve large-diameter portion 302 in radial directions are disposed in such a way as to communicate with the valve hollow passage 311.

When it is assumed that outer diameter of the valve large-diameter portions 301, 302, and 303, outer diameter of the valve small-diameter portion 304, and outer diameter of the valve medium-diameter portion 305 are denoted by ϕD1, ϕD2, and ϕD3, respectively and inner diameter of the valve hollow passage 311 is denoted by ϕD4, relations between ϕD1 to ϕD4 are expressed by Formula 1 below:

$$\phi D4<\phi D2<\phi D3<\phi D1 \quad \text{(Formula 1).}$$

When it is assumed that pressure receiving areas of the valve front end face 308, the valve rear end face 309, the valve stepped face (front) 310, and the valve stepped face (rear) 312 are denoted by S1, S2, S3, and S4, respectively, the pressure receiving areas are expressed by Formula 2 below:

$$S1=\pi/4\times(D2^2-D4^2),$$

$$S2=\pi/4\times(D3^2-D4^2),$$

$$S3=\pi/4\times(D1^2-D2^2), \text{ and}$$

$$S4=\pi/4\times(D1^2-D3^2) \quad \text{(Formula 2).}$$

Relations among the pressure receiving areas S1 to S4 are expressed by Formulae 3 to 5 below:

$$S1<S2 \quad \text{(Formula 3)},$$

$$[S1+S3]>S2 \quad \text{(Formula 4), and}$$

$$S3>S4 \quad \text{(Formula 5)}.$$

A difference between the pressure receiving areas S2 and S1 corresponds to the "reverse operation biasing portion", described in the Brief Summary above, that operates when the reverse operation circuit is connected to the high pressure circuit, and the pressure receiving area S4 corresponds to the "forward operation biasing portion", described in the Brief Summary above, that operates when the forward operation circuit is connected to the high pressure circuit. The "reverse operation biasing portion" and the "forward operation biasing portion" correspond to the "valve biasing portion" described in the Brief Summary above. The pressure receiving area S3 corresponds to the "valve control portion" described in the Brief Summary above, that, when pressurized oil is supplied, moves the valve rearward against biasing force of the valve biasing portion.

When, in FIG. 2, a sidewall on the front side of the piston reverse operation port 134, a sidewall on the rear side of the piston reverse operation port 134, a sidewall on the rear side of the piston front chamber forward operation port 135, a sidewall on the front side of the piston rear chamber forward operation port 136, a sidewall on the front side of the piston front chamber switching groove 306, a sidewall on the rear side of the piston front chamber switching groove 306, a sidewall on the front side of the piston rear chamber switching groove 307, and a sidewall on the rear side of the piston rear chamber switching groove 307 are denoted by reference numerals 134*a*, 134*b*, 135*b*, 136*a*, 306*a*, 306*b*, 307*a*, and 307*b*, respectively, relations among opening widths and sealing lengths of ports that the valve 300 and the valve chamber 130 cooperatively form are expressed as follows.

When the following denotation is assumed:

(1) at the time of advancement of the valve 300:

Ln1: opening width that the piston front chamber forward operation port groove side surface (rear) 135*b* and the piston front chamber switching groove sidewall (front) 306*a* form;

Ln2: sealing length that the piston reverse operation port groove side surface (front) 134*a* and the piston front chamber switching groove sidewall (rear) 306*b* form;

Ln3: opening width that the piston reverse operation port groove side surface (rear) 134*b* and the piston rear chamber switching groove sidewall (front) 307*a* form; and Ln4: sealing length that the piston rear chamber forward operation port groove side surface (front) 136*a* and the piston rear chamber switching groove sidewall (rear) 307*b* form; and (2) at the time of retraction of the valve 300:

Lr1: sealing length that the piston front chamber forward operation port groove side surface (rear) 135*b* and the piston front chamber switching groove sidewall (front) 306*a* form;

Lr2: opening width that the piston reverse operation port groove side surface (front) 134*a* and the piston front chamber switching groove sidewall (rear) 306*b* form;

Lr3: sealing length that the piston reverse operation port groove side surface (rear) 134*b* and the piston rear chamber switching groove sidewall (front) 307*a* form; and Lr4: opening width that the piston rear chamber forward operation port groove side surface (front) 136*a* and the piston rear chamber switching groove sidewall (rear) 307*b* form, the formulae below hold:

$$Ln=Ln1=Ln2=Ln3=Ln4 \quad \text{(Formula 6)}$$

(however, the sealing lengths Ln2 and Ln4 are set to be slightly longer than the opening widths Ln1 and Ln3);

$$Lr=Lr1=Lr2=Lr3=Lr4 \quad \text{(Formula 7)}$$

(However, the sealing lengths Lr2 and Lr4 are set to be slightly longer than the opening widths Lr1 and Lr3); and $$Ln<Lr \quad \text{(Formula 8)},$$

where a difference between Ln and Lr corresponds to the "shortening portion", described in the Brief Summary above, that reduces time required for high/low pressure switching operation in the piston front chamber and the piston rear chamber in association with retraction of the valve to be shorter than time required for high/low pressure switching operation in the piston front chamber and the piston rear chamber in association with advancement of the valve.

As illustrated in FIG. 1, the reverse operation circuit 101 and the forward operation circuit 102 are connected to the piston reverse operation port 134 and both the piston front chamber forward operation port 135 and the piston rear chamber forward operation port 136, respectively. One end and the other end of the piston front chamber passage 120 are connected to the piston front chamber 110 and an intermediate portion between the piston reverse operation port 134 and the piston front chamber forward operation port 135 of the valve chamber large-diameter portion 131, respectively. One end and the other end of the piston rear chamber passage 121 are connected to the piston rear chamber 111 and an intermediate portion between the piston reverse operation port 134 and the piston rear chamber forward operation port 136 of the valve chamber large-diameter portion 131, respectively.

A valve reverse operation passage 123, a valve forward operation passage 125, and a valve control passage 126 connect between the piston retraction control port 113 and the front side end face of the valve chamber 130, between the piston advancement control port 112 and the piston rear chamber forward operation port 136, and between the valve control port 114 and the valve control chamber 137, respectively. Therefore, pressure in the valve hollow passage 311 is constantly high in the reverse operation mode and constantly low in the forward operation mode.

The valve reverse operation passage 123 may directly connect between the piston retraction control port 113 and the piston reverse operation port 134 or may directly connect between the piston retraction control port 113 and the reverse operation circuit 101. The valve forward operation passage 125 may directly connect between the piston advancement control port 112 and the piston front chamber forward operation port 135 or may directly connect between the piston advancement control port 112 and the forward operation circuit 102.

Figure 3:
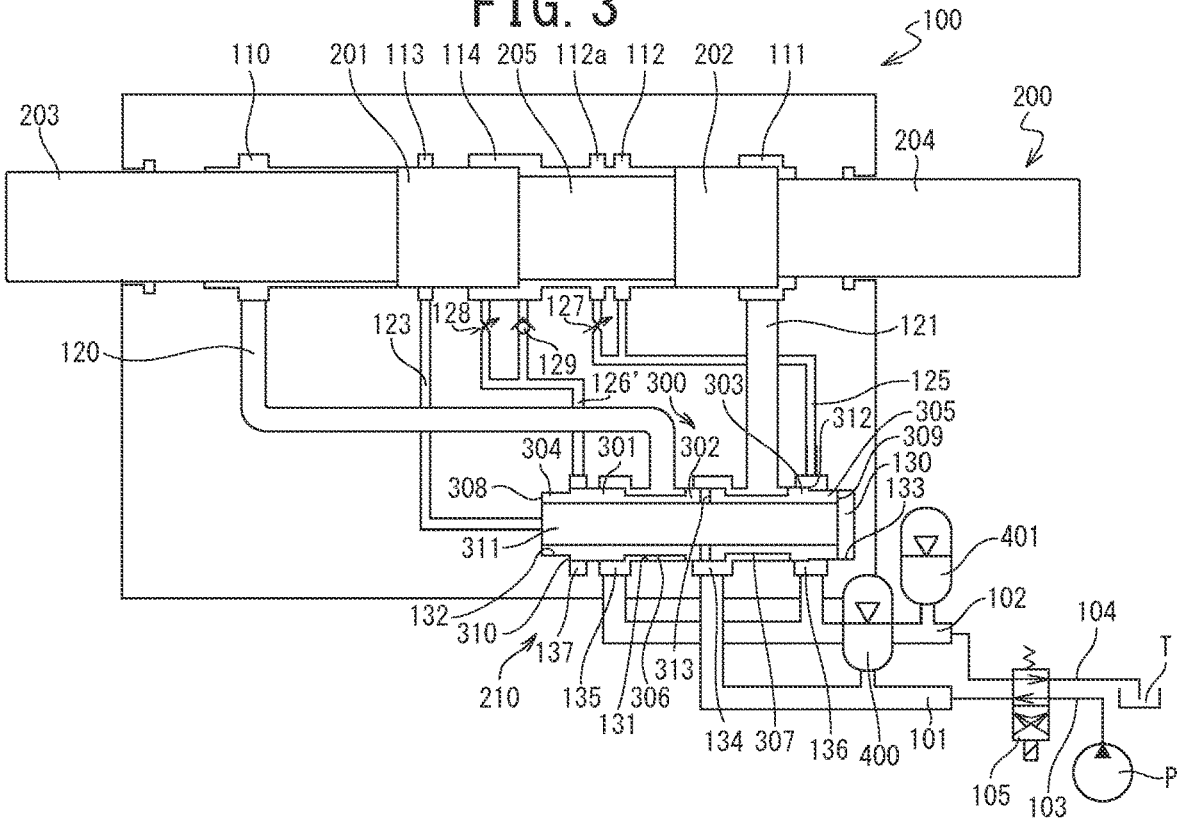
FIG. 3 is a schematic view of a second embodiment of the hydraulic striking device according to the present invention.

Next, a configuration of a hydraulic striking device of a second embodiment of the present invention will be described with reference to FIG. 3. A difference between the second and first embodiments is that the valve control passage 126 connecting between the valve control port 114 and the valve control chamber 137 in the first embodiment is altered into a valve control passage 126' by disposing a variable throttle 128 and a check valve 129 to the valve control passage 126. The check valve 129 is disposed in such a way as to allow pressurized oil to flow from the valve control port 114 side into the valve control chamber 137 and restrict pressurized oil from flowing out from the valve control chamber 137 side to the valve control port 114.

The configuration made up of the variable throttle 128 and the check valve 129 corresponds to the "delaying portion" described in the Brief Summary above. The delaying portion serves as a means for extending time required for high/low pressure switching operation in the piston front and rear chambers in association with retraction of the valve to be longer than time required for high/low pressure switching operation in the piston front and rear chambers in association with advancement of the valve. Therefore, the second embodiment includes both the "shortening portion" and the "delaying portion".

Operational effects of the first and second embodiments will be described later in detail with reference to operating principle diagrams in FIGS. 6A to 6D and 7A to 7D.

Figure 4:
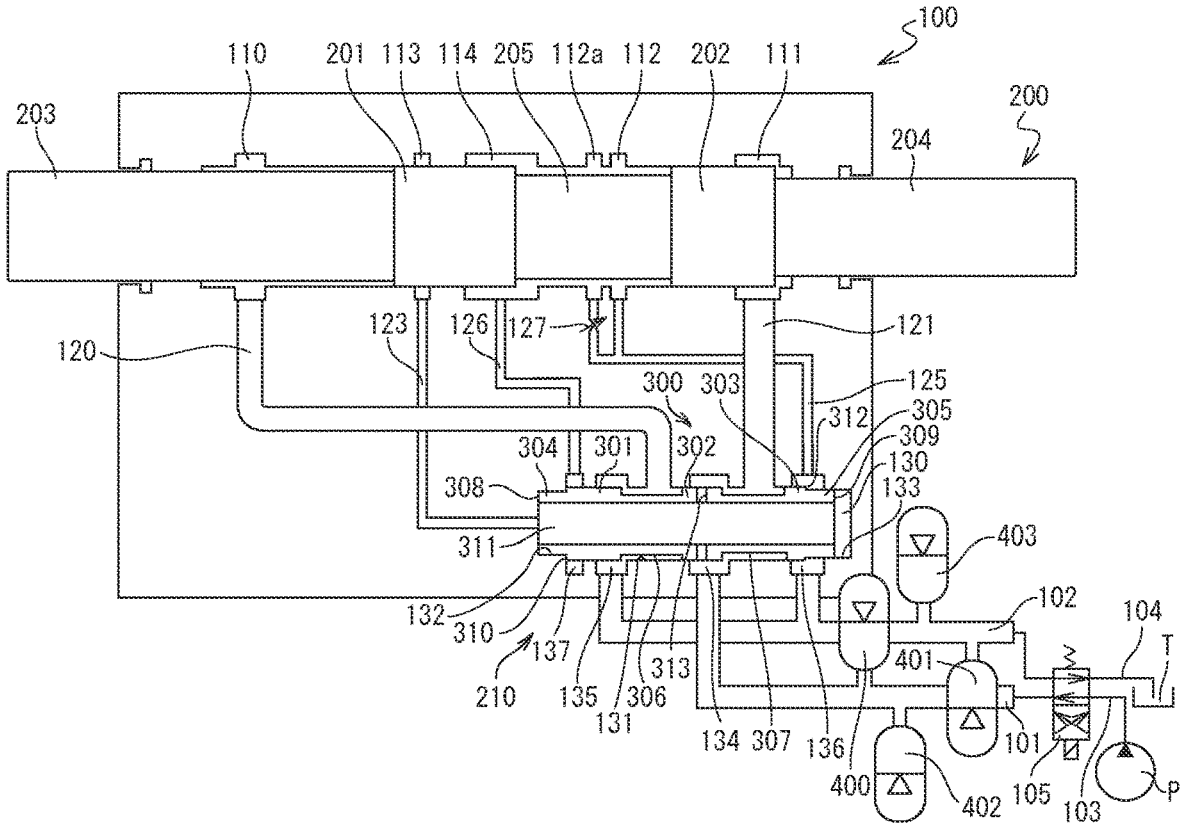
FIG. 4 is a schematic view of a third embodiment of the hydraulic striking device according to the present invention.

Next, a hydraulic striking device of a third embodiment of the present invention will be described with reference to FIG. 4. A difference from the first embodiment is that, to a reverse operation circuit 101, a high pressure accumulator 400 and a low pressure accumulator 402 are disposed side by side in such a way that the high pressure accumulator 400 is disposed on the switching valve mechanism 210 side and, therewith, to a forward operation circuit 102, a high pressure accumulator 403 and a low pressure accumulator 401 are disposed side by side in such a way that the high pressure accumulator 403 is disposed on the switching valve mechanism 210 side.

Figure 5:
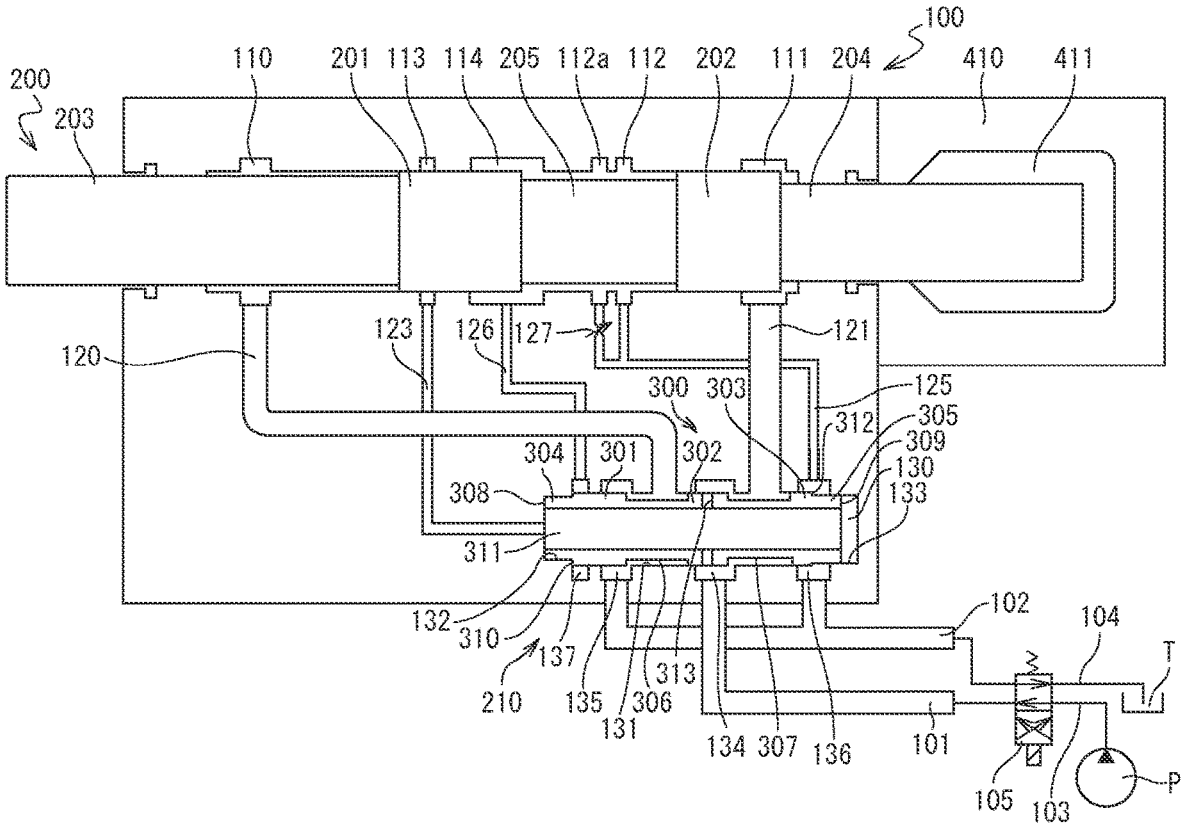
FIG. 5 is a schematic view of a fourth embodiment of the hydraulic striking device according to the present invention

Next, a hydraulic striking device of a fourth embodiment of the present invention will be described with reference to FIG. 5. A difference from the first embodiment is that a high pressure accumulator 400 and a low pressure accumulator 401 are omitted, a back head 410 is disposed in the rear of a cylinder 100, and a space inside the back head 410 into which a piston 200 is inserted is formed into a gas chamber 411 that is filled with a gas.

Next, an operation and operational effects of a hydraulic striking device of the present invention will be described using the second embodiment as an example with reference to FIGS. 6A to 6D and 7A to 7D. In FIGS. 6A to 6D and 7A to 7D, passages that are in a high pressure state and passages that are in a low pressure state are illustrated by "dark shading" and "bright shading", respectively.

In FIGS. 6A to 6D, the operation switching valve 105 has been switched to the reverse operation mode, that is, a position at which the reverse operation circuit 101 and the high pressure circuit 103 are connected to each other (a position at which the forward operation circuit 102 and the low pressure circuit 104 are connected to each other).

When, as illustrated in FIG. 6A, the valve 300 in the switching valve mechanism 210 is switched to an advanced position, the piston reverse operation port 134 comes into communication with the piston rear chamber passage 121, which causes pressure in the piston rear chamber 111 to become high. At the same time, the piston front chamber forward operation port 135 comes into communication with the piston front chamber passage 120, which causes pressure in the piston front chamber 110 to become low. This operation causes the piston 200 to advance.

At this time, the valve chamber 130 is constantly connected to the reverse operation circuit 101 via the valve main body reverse operation passages 313, which causes pressure at both the valve front end face 308 and the valve rear end face 309 to be kept high. Since high pressure works on both the valve front end face 308 and the valve rear end face 309, the valve 300 is held at the advanced position from Formula 3 described above (see FIG. 6A).

Next, as illustrated in FIG. 6B, the piston 200 advances, communication between the valve control port 114 and the piston advancement control port 112 is cut off, and, instead thereof, the valve control port 114 comes into communication with the piston retraction control port 113. This operation causes high pressure oil from the valve reverse operation passage 123 to be supplied to the valve control chamber 137 via the valve control passage 126'. Since, at this time, the pressurized oil passes the check valve 129 in the valve control passage 126', flow of the pressurized oil is not adjusted by the variable throttle 128.

When pressure in the valve control chamber 137 becomes high, the high pressure works on the valve stepped face (front) 310, which causes the valve 300 to start to retract from Formula 4 described above (see FIG. 6B). At this time, the time required for high/low pressure switching operation in the piston front chamber 110 and the piston rear chamber 111 in association with retraction of the valve 300 is in proportion to Ln from Formula 6 described above.

The piston 200 reaches an impact point when striking efficiency is maximum (between FIGS. 6B and 6C), and, at the impact point, the tip of the piston 200 strikes the rear end of a rod for striking (not illustrated). This operation causes a shock wave produced by the strike to propagate to a bit or the like at the tip of the rod via the rod and to be used as energy for crushing bedrock or the like.

Immediately after the piston 200 has reached the impact point, the valve 300 completes switching to a retracted position thereof. When the valve 300 is at the retracted position thereof, the piston reverse operation port 134 comes into communication with the piston front chamber passage 120, which causes pressure in the piston front chamber 110 to become high. At the same time, the piston rear chamber forward operation port 136 comes into communication with the piston rear chamber passage 121, which causes pressure in the piston rear chamber 111 to become low. This operation causes the piston 200 to turn to retraction. While pressure in the valve control chamber 137 is kept high, the valve 300 is held at the retracted position (see FIG. 6C).

Next, the piston 200 retracts, the communication between the valve control port 114 and the piston retraction control port 113 is cut off, and, instead thereof, the valve control port 114 comes into communication with the piston advancement control port 112. This operation causes the valve control chamber 137 to be connected to the low pressure circuit 104 via the valve control passage 126' and the valve forward operation passage 125. When pressure in the valve control chamber 137 becomes low, the valve 300 starts to advance from Formula 3 described above.

At this time, the time required for high/low pressure switching operation in the piston front chamber 110 and the piston rear chamber 111 in association with advancement of the valve 300 is in proportion to Lr from Formula 7 described above. Since, in the valve control passage 126', pressurized oil passes the variable throttle 128 blocked by the check valve 129, a flow rate in the valve control passage 126' is adjusted and the inside of the valve control passage 126' transitions from a high pressure state to a low pressure state through a medium pressure state (the passage is illustrated by "dashed lines") (see FIG. 6D). The valve 300 is switched to the advanced position again, and the striking cycle described above is repeated.

The time required for high/low pressure switching operation in the piston front chamber 110 and the piston rear chamber 111 in association with retraction of the valve 300 in FIG. 6B is reduced to be shorter than the time required for high/low pressure switching operation in the piston front chamber 110 and the piston rear chamber 111 in association with advancement of the valve 300 in FIG. 6D from Formula 8 described above. Further, since, in FIG. 6D, flow velocity of pressurized oil in the valve control passage 126' is adjusted by the variable throttle 128, advancing movement of the valve 300 is delayed.

On the other hand, in FIGS. 7A to 7D, the operation switching valve 105 has been switched to the forward operation mode, that is, a position at which the forward operation circuit 102 and the high pressure circuit 103 are connected to each other (a position at which the reverse operation circuit 101 and the low pressure circuit 104 are connected to each other). When, as illustrated in FIG. 7A, the valve 300 in the switching valve mechanism 210 is switched to a retracted position, the piston rear chamber forward operation port 136 comes into communication with the piston rear chamber passage 121, which causes pressure in the piston rear chamber 111 to become high. At the same time, the piston front chamber forward operation port 135 comes into communication with the piston front chamber passage 120, which causes pressure in the piston front chamber 110 to become low. This operation causes the piston 200 to advance.

Although, at this time, the valve chamber 130 is constantly connected to the reverse operation circuit 101 via the valve main body reverse operation passages 313 and pressure at both the valve front end face 308 and the valve rear end face 309 is thereby kept low, the valve 300 is held at the retracted position from Formula 5 described above because high pressure works on both the valve stepped face (front) 310 and the valve stepped face (rear) 312 (see FIG. 7A).

Next, the piston 200 advances, the communication between the valve control port 114 and the piston advancement control port 112 is cut off, and, instead thereof, the valve control port 114 comes into communication with the piston retraction control port 113. This operation causes high pressure oil in the valve control chamber 137 to flow out to the valve reverse operation passage 123 via the valve control passage 126'.

At this time, the time required for high/low pressure switching operation in the piston front chamber 110 and the piston rear chamber 111 in association with advancement of the valve 300 is in proportion to Lr from Formula 7 described above. Since, in the valve control passage 126', pressurized oil passes the variable throttle 128 blocked by the check valve 129, a flow rate in the valve control passage 126' is adjusted and the inside of the valve control passage 126' transitions from a high pressure state to a low pressure state through a medium pressure state. When pressure in the valve control chamber 137 becomes low, high pressure works on only the valve stepped face (rear) 312, which causes the valve 300 to start to advance (see FIG. 7B).

The piston 200 reaches an impact point increasing striking efficiency (between FIGS. 7B and 7C), and, at the impact point, the tip of the piston 200 strikes the rear-end of the rod for striking (not illustrated). This operation causes a shock wave produced by the strike to propagate to a bit or the like at the tip of the rod via the rod and to be used as energy for crushing bedrock or the like.

When the valve 300 is at the advanced position thereof, the piston front chamber forward operation port 135 comes into communication with the piston front chamber passage 120, which causes pressure in the piston front chamber 110 to become high. At the same time, the piston reverse operation port 134 comes into communication with the piston rear chamber passage 121, which causes pressure in the piston rear chamber 111 to become low.

This operation causes the piston 200 to turn to retraction. While pressure in the valve control chamber 137 is kept low, the valve 300 is held at the advanced position. Although the valve 300 completes movement to the advanced position thereof slightly later than a point of time at which the piston 200 reaches the impact point as will be described later, the timing difference has little influence on striking power because the piston 200 has already started retracting movement due to rebound after the strike on the rod (FIG. 7C).

Next, the piston 200 retracts, the communication between the valve control port 114 and the piston retraction control port 113 is cut off, and, instead thereof, the valve control port 114 comes into communication with the piston advancement control port 112. This operation causes the valve control chamber 137 to be connected to the forward operation circuit 102 via the valve control passage 126' and the valve forward operation passage 125. When pressure in the valve control chamber 137 becomes high, the valve 300 starts to retract from Formula 5 described above.

At this time, the time required for high/low pressure switching operation in the piston front chamber 110 and the piston rear chamber 111 in association with retraction of the valve 300 is in proportion to Ln from Formula 6 described above. Since the pressurized oil passes the check valve 129 in the valve control passage 126', flow of the pressurized oil is not adjusted by the variable throttle 128 (see FIG. 7D). The valve 300 is switched to the advanced position again, and the striking cycle described above is repeated.

The time required for high/low pressure switching operation in the piston front chamber 110 and the piston rear chamber 111 in association with retraction of the valve 300 in FIG. 7D is reduced to be shorter than the time required for high/low pressure switching operation in the piston front chamber 110 and the piston rear chamber 111 in association with advancement of the valve 300 in FIG. 7B from Formula 8 described above. Further, in FIG. 7B, since flow velocity of pressurized oil in the valve control passage 126' is adjusted by the variable throttle 128, advancing movement of the valve 300 is delayed.

Next, the reverse operation mode illustrated in FIGS. 6A to 6D and the forward operation mode illustrated in FIGS. 7A to 7D are compared with each other focusing on the "shortening portion", which is a main constituent element of the present invention.

a) In a phase in which the piston 200 turns from retraction to advancement

The valve 300 is held at the advanced position in the reverse operation mode (FIG. 6A) and the retracted position in the forward operation mode (FIG. 7A), and there is no difference in the advancing movement of the piston 200 between both modes.

b) In a phase in which the piston 200 advances and the piston retraction control port 113 comes into communication The valve 300 turns to retraction in the reverse operation mode (FIG. 6B) and turns to advancement in the forward operation mode (FIG. 7B).

From Formula 8 described above, the time required for high/low pressure switching operation in the piston front chamber 110 and the piston rear chamber 111 in association with retraction of the valve is reduced to be shorter than the time required for high/low pressure switching operation in the piston front chamber 110 and the piston rear chamber 111 in association with advancement of the valve. Since, as described afore, general hydraulic striking devices employ the reverse operation mode, switching timing of the valve 300 in the reverse operation mode is set as a regular timing in this phase, which means that switching timing of the valve 300 in the forward operation mode is relatively delayed.

c) In a phase in which the piston 200 reaches the impact point and the valve 300 completes switching Even though, as described in the item b), in the forward operation mode (during a process from FIG. 7B to FIG. 7C), the switching timing of the valve 300 when the piston 200 turns from advancement to retraction is delayed from the regular timing with respect to the reverse operation mode (during a process from FIG. 6B to FIG. 6C), the delay does not have a large influence on striking characteristics because the piston 200 turns to retraction due to rebound after the piston 200 has reached the impact point and struck the rod.

d) In a phase in which the piston 200 retracts and the piston advancement control port 112 comes into communication The valve 300 turns to advancement in the reverse operation mode (FIG. 6D) and turns to retraction in the forward operation mode (FIG. 7D).

As with the item b) described above, the time required for high/low pressure switching operation in the piston front chamber 110 and the piston rear chamber 111 in association with retraction of the valve is reduced to be shorter than the time required for high/low pressure switching operation in the piston front chamber 110 and the piston rear chamber 111 in association with advancement of the valve. Therefore, a switching timing of the valve 300 in the forward operation mode is shifted to an earlier point of time than a switching timing of the valve 300 in the reverse operation mode, as a result of which a retraction completion position, that is, a back dead point, of the piston 200 moves forward and the piston stroke is thereby shortened.

Summarizing the above description, disposing the "shortening portion" to the switching valve mechanism 210 enables a stroke to be shortened in the forward operation mode when compared with the reverse operation mode. Therefore, it is possible to perform regular work by use of the reverse operation mode and perform work requiring light strikes using low striking power by switching to the forward operation mode by means of the operation switching valve 105. Note that the first embodiment includes only the "shortening portion" described above.

Next, the reverse operation mode illustrated in FIGS. 6A to 6D and the forward operation mode illustrated in FIGS. 7A to 7D are compared with each other focusing on the "delaying portion", which is another main constituent element of the present invention.

a') In a phase in which the piston 200 turns from retraction to advancement

The valve 300 is held at the advanced position in the reverse operation mode (FIG. 6A) and the retracted position in the forward operation mode (FIG. 7A), and there is no difference in the advancing movement of the piston 200 between both modes.

b') In a phase in which the piston 200 advances and the piston retraction control port 113 comes into communication Since, although the variable throttle 128 does not work in the reverse operation mode (FIG. 6B), velocity at which high pressure oil flows out from the valve control chamber 137 is adjusted by the variable throttle 128 in the forward operation mode (FIG. 7B), switching timing of the valve 300 in the forward operation mode is delayed.

c') In a phase in which the piston 200 reaches the impact point and the valve 300 completes switching Even though, as described in the item b), in the forward operation mode (during a process from FIG. 7B to FIG. 7C), the switching timing of the valve 300 when the piston 200 turns from advancement to retraction is delayed from the regular timing with respect to the reverse operation mode (during a process from FIG. 6B to FIG. 6C), the delay does not have a large influence on striking characteristics because the piston 200 turns to retraction due to rebound after the piston 200 has reached an impact point and struck the rod.

d') In a phase in which the piston 200 retracts and the piston advancement control port 112 comes into communication Since, in the reverse operation mode (FIG. 6D), velocity at which high pressure oil flows out from the valve control chamber 137 is adjusted by the variable throttle 128 and, in the forward operation mode (FIG. 7D), the variable throttle 128 does not work, switching timing of the valve 300 in the reverse operation mode is delayed, the retraction completion position, that is, the back dead point, of the piston 200 moves rearward, and the piston stroke is thereby extended.

Summarizing the above description, disposing the "delaying portion" to the switching valve mechanism 210 enables a stroke to be extended in the reverse operation mode when compared with the forward operation mode. The amount of extension in a stroke can be controlled by the amount of adjustment of the variable throttle 128.

Figure 8:
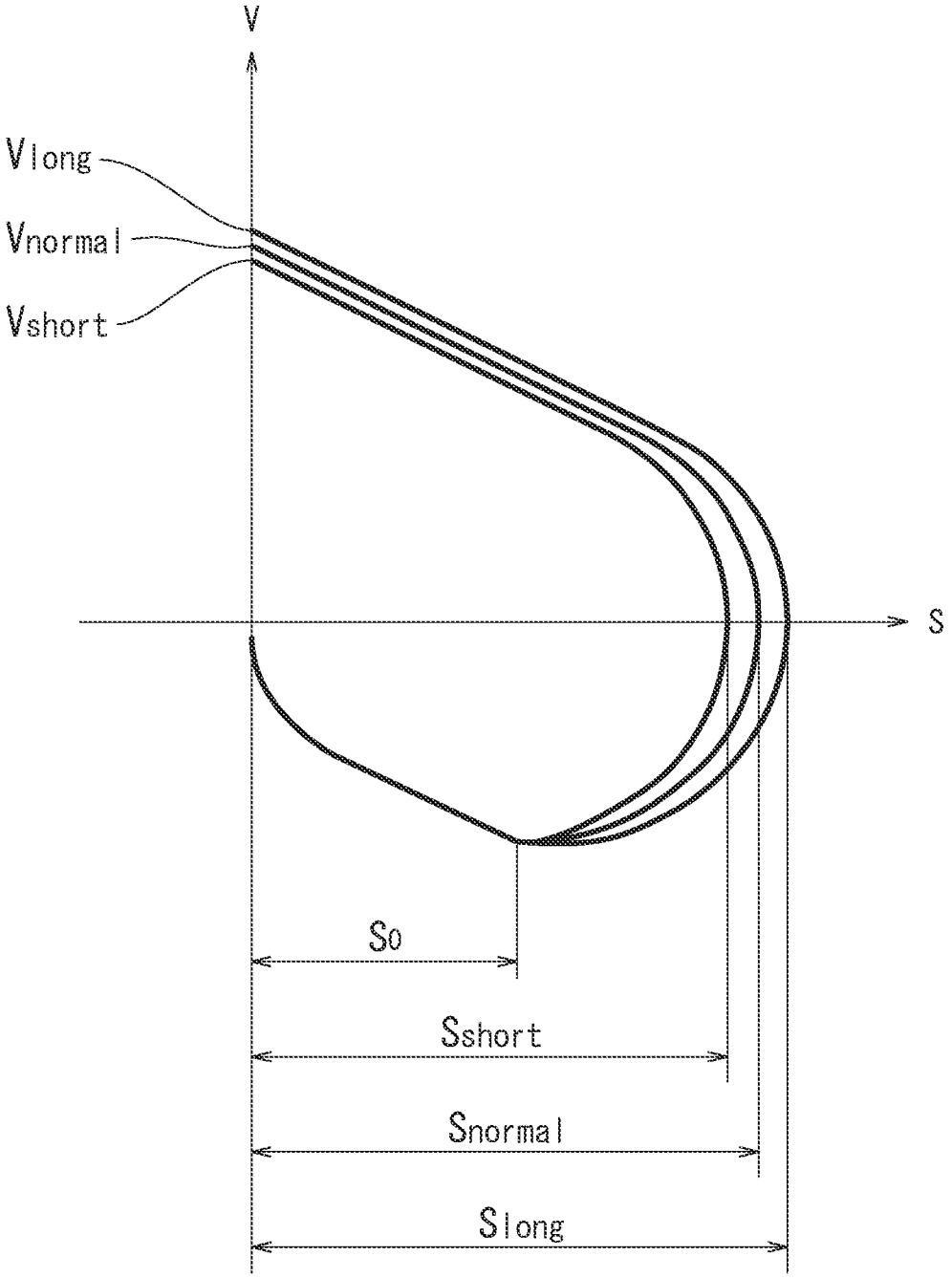
FIG. 8 is a piston stroke-velocity diagram of the respective operation modes.
Figure 9:
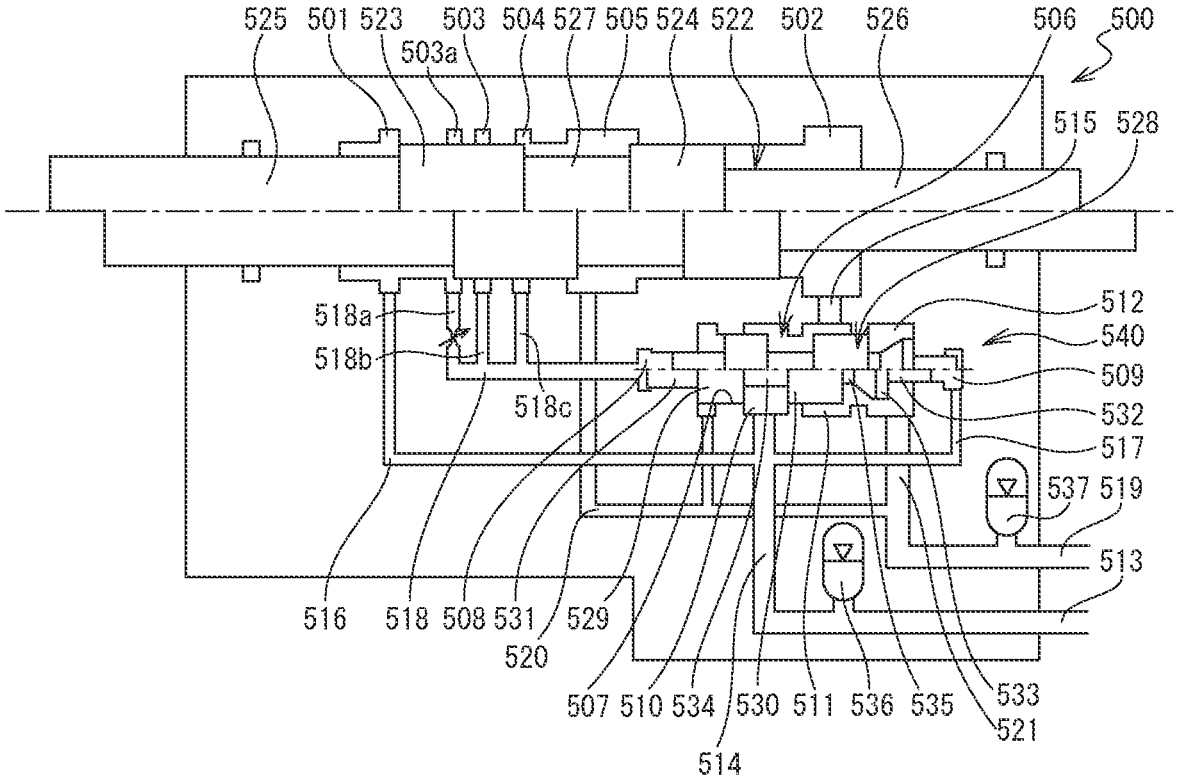
FIG. 9 is a schematic view descriptive of an example of a conventional hydraulic striking device.

Therefore, according to the hydraulic striking device of the present embodiment, as illustrated in a piston stroke-velocity diagram in FIG. 8, disposing the shortening portion and the delaying portion enables the piston stroke to, in the forward operation mode, be set at a short stroke (S short in FIG. 8) and, in the reverse operation mode, to be set at a stroke that can be changed within a range from a normal stroke (Snormal in FIG. 8) to a long stroke (Slong in FIG. 8).

Note that, in FIG. 8, the abscissa S and the ordinate V represent the piston stroke and the piston velocity, respectively, Vlong, Vnormal, and Vshort represent velocities at the time of strikes when in operation along the short stroke S short, the normal stroke Snormal, and the long stroke Slong, respectively, and $S_0$ represents a stroke at a maximum velocity when the piston retracts from an impact point.

Next, comparison between the first and third embodiments of the present invention, that is, operational effects provided by a difference in layouts of accumulators, will be described.

Since, as described afore, the reverse operation mode is employed as a regular operation mode in the present invention, the high pressure accumulator 400 and the low pressure accumulator 401 are arranged in the reverse operation circuit 101 and the forward operation circuit 102, respectively, in the first embodiment. While the high pressure accumulator 400 and the low pressure accumulator 401 use common constituent components, such as a pressure container and a diaphragm, setting values of pressure of a sealed gas are set at a high pressure and a low pressure for the high pressure accumulator 400 and the low pressure accumulator 401, respectively.

In the first embodiment, since the operation switching valve 105 is switched to a reverse operation mode position as a regular operation mode, the high pressure accumulator 400 absorbs shock and pulsation propagating through high pressure oil by accumulating the high pressure oil and, when the amount of oil becomes insufficient in the circuit, makes up the insufficiency in supply of the pressurized oil by discharging the accumulated pressurized oil. On the other hand, the low pressure accumulator 401 absorbs shock and pulsation propagating through low pressure oil by accumulating the low pressure oil.

In the first embodiment, there is a concern that, when the forward operation mode is selected by switching the operation switching valve 105, pressure in the high pressure accumulator 400 and pressure in the low pressure accumulator 401 become low and high, respectively and, in particular, the low pressure accumulator 401, which is caused to accumulate high pressure oil, may have a lack of performance. However, since, as described in the operating principle diagrams, the forward operation mode causes the piston stroke to be shortened to a short stroke, shock and pulsation in the passages become relatively moderate. Therefore, there is no significant inconvenience in use of the low pressure accumulator 401.

On the other hand, in the third embodiment, since a pair of the high pressure accumulator 400 and the low pressure accumulator 402 and a pair of the high pressure accumulator 403 and the low pressure accumulator 401 are disposed to the reverse operation circuit 101 and the forward operation circuit 102 side by side in such a way that the high pressure accumulators 400 and 403 are disposed on the switching valve mechanism 210 side, respectively, it becomes possible for the high pressure accumulators and the low pressure accumulators to achieve the original performance even when either the reverse operation mode or the forward operation mode is selected.

Next, operational effects of the fourth embodiment of the present invention will be described.

Operational effects of accumulators used in a hydraulic striking device of this type include a "buffering action" for preventing equipment from being damaged by absorbing shock and pulsation propagating through pressurized oil in a circuit and an "energy accumulation action" for accumulating pressurized oil when the amount of oil in the circuit is excessive with respect to the amount of discharge from a pump and discharging accumulated pressurized oil when the amount of oil is insufficient.

Focusing on the energy accumulation action, since excess and deficiency in the amount of oil in the circuit are caused by advancing and retracting movements of the piston 200, it can be said that the accumulators converts kinetic energy of the piston 200 into striking energy by using pressurized oil as a medium and accumulating and discharging the pressurized oil.

On the other hand, the fourth embodiment, instead of converting kinetic energy of the piston 200 into striking energy by using pressurized oil as a medium, converts kinetic energy at the time of retraction of the piston 200 into striking energy by directly accumulating and discharging the kinetic energy in the gas chamber 411 of the back head 410.

A basic concept of the present invention is to change striking characteristics by switching the high pressure circuit 103 and the low pressure circuit 104 in an interchanging manner. Although it was described above that, in the first embodiment, the high pressure accumulator 400 and the low pressure accumulator 401 are disposed to the high pressure circuit 103 and the low pressure circuit 104, respectively and there may occur a case where the respective accumulators cannot achieve the original performance thereof due to the circuit switching, the energy accumulation action by the back head 410 is suitable for the present invention because the circuit switching does not affect the energy accumulation action by the back head 410.

However, with regard to the buffering action for preventing equipment from being damaged by shock and pulsation propagating through pressurized oil in the circuit, although the back head 410, as an alternative means to an accumulator, can buffer such shock and pulsation to some extent, effect of the buffering action by the back head 410 is limited when compared with an accumulator. For this reason, it is preferable to employ the fourth embodiment for a small-size hydraulic striking mechanism in which shock and pulsation in the pressurized oil in the circuit is relatively small.

The fourth embodiment is preferable because omission of accumulators enables a hydraulic striking device to be miniaturized and the configuration thereof to be simplified.

Although the embodiments of the present invention were described above with reference to the accompanying drawings, the hydraulic striking device employing the piston front/rear chamber high/low pressure switching method according to the present invention is not limited to the above-described embodiments, and it should be understood that other various modifications and alterations to the respective constituent components can be made unless departing from the spirit and scope of the present invention.

For example, although, in the embodiments described above, a case where, as in the switching valve mechanism illustrated in FIG. 2, opening widths (sealing lengths) between the valve and the ports are used as a measure for creating a time difference between a valve advancing movement and a valve retracting movement was described, it is possible to, without being limited to the case, create a time difference by setting a difference between pressure receiving areas and it is also possible to create a time difference by using a hydraulic line area difference between a reverse operation circuit and a forward operation circuit, that is, a difference in hydraulic line resistance.

Although the axis of the piston and the axis of the valve are parallel with each other, setting the axes in the orthogonal directions does not affect the function of the hydraulic striking device. The first embodiment and the fourth embodiment may be embodied at the same time, that is, accumulators may be respectively disposed to the high pressure circuit and the low pressure circuit and, in conjunction therewith, a back head equipped with a gas chamber is disposed to a rear portion of the cylinder.

Below is a list of reference numbers used in the drawings.

100 Cylinder
101 Reverse operation circuit
102 Forward operation circuit
103 High pressure circuit
104 Low pressure circuit
105 Operation switching valve
110 Piston front chamber
111 Piston rear chamber
112 Piston advancement control port
112*a* Piston advancement control port (short stroke)
113 Piston retraction control port
114 Valve control port
120 Piston front chamber passage
121 Piston rear chamber passage
123 Valve reverse operation passage
125 Valve forward operation passage
126, 126' Valve control passage
127 Variable throttle
128 Variable throttle
129 Check valve
130 Valve chamber
131 Valve chamber large-diameter portion
132 Valve chamber small-diameter portion
133 Valve chamber medium-diameter portion
134 Piston reverse operation port
134*a* Piston reverse operation port groove side surface (front)
134*b* Piston reverse operation port groove side surface (rear)

135 Piston front chamber forward operation port
135*b* Piston front chamber forward operation port groove side surface (rear)
136 Piston rear chamber forward operation port
136*a* Piston rear chamber forward operation port groove side surface (front)
137 Valve control chamber
200 Piston
201 Large-diameter portion (front)
202 Large-diameter portion (rear)
203 Small-diameter portion (front)
204 Small-diameter portion (rear)
205 Valve switching groove
210 Switching valve mechanism
300 Valve
301 Valve large-diameter portion (front)
302 Valve large-diameter portion (middle)
303 Valve large-diameter portion (rear)
304 Valve small-diameter portion
305 Valve medium-diameter portion
306 Piston front chamber switching groove
306*a* Piston front chamber switching groove sidewall (front)
306*b* Piston front chamber switching groove sidewall (rear)
307 Piston rear chamber switching groove
307*a* Piston rear chamber switching groove sidewall (front)
307*b* Piston rear chamber switching groove sidewall (rear)
308 Valve front end face
309 Valve rear end face
310 Valve stepped face (front)
311 Valve hollow passage
312 Valve stepped face (rear)
313 Valve main body reverse operation passage
400 High pressure accumulator
401 Low pressure accumulator
402 Low pressure accumulator
403 High pressure accumulator
410 Back head
411 Gas chamber
Ln1, Ln2, Ln3, Ln4 Forward operation opening width (sealing length)
Lr1, Lr2, Lr3, Lr4 Reverse operation opening width (sealing length)
P Pump
T Tank
500 Cylinder
501 Piston front chamber
502 Piston rear chamber
503 Piston advancement control port
503*a* Piston advancement control port (short stroke)
504 Piston retraction control port
505 Oil discharge port
506 Valve chamber
507 Valve main chamber
508 Valve front chamber
509 Valve rear chamber
510 Piston rear chamber high pressure port
511 Piston rear chamber switching port
512 Piston rear chamber low pressure port
513 High pressure circuit
514 High pressure passage
515 Piston rear chamber passage
516 Piston front chamber passage
517 Valve rear chamber passage
518 Valve control passage
518*a* Valve front chamber high pressure passage (short stroke)
518*b* Valve front chamber high pressure passage
518*c* Valve front chamber low pressure passage
519 Low pressure circuit
520 Valve low pressure passage
521 Piston low pressure passage
522 Piston
523 Large-diameter portion (front)
524 Large-diameter portion (rear)
525 Medium-diameter portion
526 Small-diameter portion
527 Valve switching groove
528 Valve
529 Valve large-diameter portion (front)
530 Valve large-diameter portion (rear)
531 Valve medium-diameter portion
532 Valve small-diameter portion
533 Valve retraction restricting portion
534 Piston rear chamber high pressure switching groove
535 Piston rear chamber low pressure switching groove
536 High pressure accumulator
537 Low pressure accumulator
540 Switching valve mechanism

The invention claimed is:

1. A hydraulic striking device comprising:

a cylinder;

a piston slidably fitted in an inside of the cylinder;

a piston front chamber and a piston rear chamber defined between an outer peripheral surface of the piston and an inner peripheral surface of the cylinder and arranged separated from each other in axially front and rear directions; and a switching valve mechanism configured to switch the piston front chamber and the piston rear chamber into a high pressure state and a low pressure state in an interchanging manner, the piston being advanced and retracted in the cylinder to strike a rod for striking, wherein:

the switching valve mechanism includes a valve chamber formed in the cylinder in a non-concentric manner with the piston, a valve slidably fitted in the valve chamber and to which a high/low pressure switching portion for switching the piston front chamber and the piston rear chamber into a high pressure state and a low pressure state in an interchanging manner is formed, a valve biasing portion configured to constantly bias the valve forward, and a valve control portion configured to, when pressurized oil is supplied, move the valve rearward against biasing force by the valve biasing portion, to the switching valve mechanism, a reverse operation circuit and a forward operation circuit are connected and connection states of the reverse operation circuit and the forward operation circuit to a high pressure circuit and a low pressure circuit are interchangeable by means of an operation switching valve, the valve biasing portion includes a reverse operation biasing portion configured to operate when the reverse operation circuit is connected to the high pressure circuit and a forward operation biasing portion configured to operate when the forward operation circuit is connected to the high pressure circuit, the hydraulic striking device is configured to, through operation of the operation switching valve, be selectable between a reverse operation mode in which the valve and the piston are operated in opposite phases and a forward operation mode in which the valve and the piston are operated in the same phase, and to the high/low pressure switching portion, a shortening portion is disposed, the shortening portion reducing a switching time taken to switch the piston front chamber and the piston rear chamber between the high pressure state and the low pressure state by retraction of the valve to be shorter than a switching time taken to switch the piston front chamber and the piston rear chamber between the high pressure state and the low pressure state by advancement of the valve.

2. The hydraulic striking device according to claim 1, wherein:

the shortening portion is a difference between an opening width of a port that is closed by the valve at a time of advancement of the valve and an opening width of a port that is closed by the valve at a time of retraction of the valve.

3. The hydraulic striking device according to claim 2, wherein:

the valve control portion includes a delaying portion including a throttle configured to provide no restriction when pressurized oil is supplied and adjust a flow rate when pressurized oil is discharged.

4. The hydraulic striking device according to claim 3, comprising:

a high pressure accumulator disposed to the reverse operation circuit and a low pressure accumulator disposed to the forward operation circuit.

5. The hydraulic striking device according to claim 3, comprising: pairs of a high pressure accumulator and a low pressure accumulator respectively disposed to the reverse operation circuit and the forward operation circuit, wherein each of the pairs of the high pressure accumulator and the low pressure accumulator are disposed side by side in such a way that the high pressure accumulator is disposed on the switching valve mechanism side.

6. The hydraulic striking device according to claim 2, comprising:

a high pressure accumulator disposed to the reverse operation circuit and a low pressure accumulator disposed to the forward operation circuit.

7. The hydraulic striking device according to claim 2, comprising:

pairs of a high pressure accumulator and a low pressure accumulator respectively disposed to the reverse operation circuit and the forward operation circuit, wherein each of the pairs of the high pressure accumulator and the low pressure accumulator are disposed side by side in such a way that the high pressure accumulator is disposed on the switching valve mechanism side.

8. The hydraulic striking device according to claim 1, wherein:

the valve control portion includes a delaying portion including a throttle configured to provide no restriction when pressurized oil is supplied and to adjust a flow rate when pressurized oil is discharged.

9. The hydraulic striking device according to claim 8, comprising:

a high pressure accumulator disposed to the reverse operation circuit and a low pressure accumulator disposed to the forward operation circuit.

10. The hydraulic striking device according to claim 8, comprising:

pairs of a high pressure accumulator and a low pressure accumulator respectively disposed to the reverse operation circuit and the forward operation circuit, wherein each of the pairs of the high pressure accumulator and the low pressure accumulator are disposed side by side in such a way that the high pressure accumulator is disposed on the switching valve mechanism side.

11. The hydraulic striking device according to claim 1, comprising a high pressure accumulator disposed to the reverse operation circuit and a low pressure accumulator disposed to the forward operation circuit.

12. The hydraulic striking device according to claim 1, comprising pairs of a high pressure accumulator and a low pressure accumulator respectively disposed to the reverse operation circuit and the forward operation circuit, wherein each of the pairs of the high pressure accumulator and the low pressure accumulator are disposed side by side in such a way that the high pressure accumulator is disposed on the switching valve mechanism side.

* * * * *